United States Patent [19]

Sato et al.

[11] Patent Number: 4,764,779

[45] Date of Patent: Aug. 16, 1988

[54] ELECTROCONDUCTIVE FIBROUS MATERIAL

[75] Inventors: Seizo Sato, Otsu; Yasuhiro Shikama, Mino, both of Japan

[73] Assignee: Asahi Kasei Kogyo Kabushiki Kaisha, Osaka, Japan

[21] Appl. No.: 909,278

[22] Filed: Sep. 19, 1986

[51] Int. Cl.[4] ..... H01Q 1/36

[52] U.S. Cl. ..... 343/897; 343/915

[58] Field of Search ..... 343/897, 915; 139/425 R; 245/2

[56] References Cited

U.S. PATENT DOCUMENTS

| | | | |
|---|---|---|---|
| 2,412,562 | 12/1946 | Crawshaw | 343/897 |
| 2,494,255 | 1/1950 | Morris et al. | 343/897 |
| 2,750,321 | 6/1956 | Kappelman | 343/897 |
| 3,102,268 | 8/1963 | Foley | 343/897 |
| 4,320,403 | 3/1982 | Ebneth | 343/897 |
| 4,549,187 | 10/1985 | Levy | 343/897 |
| 4,609,923 | 9/1986 | Bean et al. | 343/897 |
| 4,647,495 | 3/1987 | Kanayama et al. | 428/246 |

*Primary Examiner*—William L. Sikes
*Assistant Examiner*—Robert E. Wise
*Attorney, Agent, or Firm*—Finnegan, Henderson Farabow, Garrett and Dunner

[57] ABSTRACT

Disclosed is an electroconductive fibrous material comprising a composite yarn comprising a core yarn composed of at least one kind of fiber selected from organic fibers and inorganic fibers and a covering layer composed of a ribbon-shaped metal fiber spirally wound around the core yarn, the coverge of the ribbon-shaped metal fiber to the core yarn being at least 50%. The electroconductive fibrous material is used for a parabolic reflecting body of a parabolic antenna and as an electromagnetic were shielding material. A collapsible parbolic antenna is also disclosed which has a collapsible framework comprising a central shaft, a plurality of wing ribs rotatably pivoted on one point of the central shaft, a bracket slidably attached to the central shaft and a plurality of push-up ribs for connecting the wing ribs to the bracket, and a sheet supported by the wing ribs to cover spaces between adjacent wing ribs, which sheet is made of the electroconductive fibrous material.

17 Claims, 3 Drawing Sheets

ELECTROCONDUCTIVE FIBROUS MATERIAL

BACKGROUND OF THE INVENTION (1) Field of the Invention

The present invention relates to an electroconductive fibrous material. More particularly, the present invention relates to an electroconductive fibrous material which is valuable as an electromagnetic wave shielding material or a parabolic antenna reflecting material in electronic equipments such as wireless installations including television and radio sets and electronic application devices. The present invention also relates to a collapsible parabolic antenna.

(2) Description of the Related Art

With development of electronic equipments and installations, electromagnetic waves have been widely utilized. Accordingly, interference occurs between one electromagnetic wave and another and electromagnetic waves have an adverse influence on one another, and thus various problems arise. As means for avoiding these electromagnetic wave problems, there have been developed various electromagnetic wave shielding materials. For example, metallic wire mesh (knitted metal wire mesh and expanded metals) and electroconductive textile materials obtained by chemically plating a fiber or a fabric or coating a fiber or a fabric with an electroconductive paint, as disclosed in Japanese Unexamined Patent Publication No. 49-29,901.

Since an electroconductive material prepared from a metallic wire mesh or plate-like material as described above has poor bending characteristics, bending or cutting of the material is difficult. Also, the weight of such a material is excessive and the material is not suitable for use when the weight or size of devices or apparatuses must be reduced. Moreover, a metal wire mesh formed of metal yarns having a fine diameter has a disadvantage in that wrinkles are readily formed and shaping is difficult.

L'INDUSTRIE TEXTILE NO. 1133, MAI, 1983 introduced an electroconductive fabric prepared by inserting metal fibers into warps and wefts at the fabric-forming step. In this fabric, however, since metal fibers are linearly inserted as in the case of a woven fabric of a metal, the bending characteristics are poor and the fabric is not suitable for the formation of an article having curved faces.

A material obtained by forming an electroconductive coating layer on a textile fabric by chemical plating or coating is not easily wrinkled and has a relatively light weight, and this material is suitable for use in an apparatus or device for which the weight and size must be reduced. In this material, however, the peel strength of the coating layer and the durability thereof are unsatisfactory. Moreover, large deviations of the quality due to uneven plating or coating occur, and the manufacturing cost is large.

Since the start of particle utilization of broadcasting satellites there have been serious developments in the use of parabolic antennae. Reflecting bodies used for conventional parabolic antennae are generally prepared from draw-formed products of aluminum plate or FRP plate rendered electroconductive by the incorporation of metal wire meshes, aluminum-vacuum-deposited glass fibers or carbon fibers. However, these reflecting bodies have disadvantages in that the processing steps are complicated, the manufacturing cost is large, the resistance to wind is unsatisfactory and fluctuations of the wave reception state by so-called deflections are large. In order to prevent such deflections, it is necessary to increase the weight of the reflecting body, and if this requirement is satisfied, the handling of the antenna becomes difficult and the manufacturing cost is increased. Furthermore, a parabolic antenna formed of a metal plate is heavy and is difficult to carry about, and a large space is necessary for mounting this type of antenna.

SUMMARY OF THE INVENTION

It is a primary object of the present invention to provide an electroconductive material which is relatively easily shaped, has a relatively light weight, has a stable equality and is manufactured at a low cost. This electroconductive material is valuable as an electromagnetic wave fault-preventing material to be used for electronic installations or devices or as a material for a reflecting body of a parabolic antenna.

Another object of the present invention is to provide a cheap parabolic antenna in which the foregoing problems are solved and which is light in the weight, collapsible and easy to handle.

In accordance with one fundamental aspect of the present invention, there is provided an electroconductive fibrous material comprising a composite yarn comprising a core yarn composed of at least one kind of fiber selected from organic fibers and inorganic fibers and a covering layer composed of a ribbon-shaped metal fiber wound spirally around the core yarn, the coverage of the ribbon-shaped metal fiber on the core yarn being at least 50%.

In accordance with another aspect of the present invention, there is provided a parabolic reflecting body composed of the above-mentioned electroconductive magnetic material.

In accordance with still another object of the present invention, there is provided a collapsible parabolic antenna which comprises a collapsible framework comprising a central shaft, a plurality of wing ribs rotatably pivoted at one point on said central shaft, a bracket slidably attached to said central shaft and a plurality of push-up ribs connecting said wing ribs to the bracket, and a sheet supported to the wing ribs to cover spaces between adjacent wing ribs, wherein the shape of the wing ribs is determined so that when the parabolic antenna is opened, a paraboloid is formed. The sheet is composed of the above-mentioned electroconductive fibrous material.

Furthermore, in accordance with the present invention, there is provided an electromagnetic wave shielding material composed of the above-mentioned electroconductive fibrous material.

DESCRIPTION OF THE PREFERRED EMBODIMENTS

Figure 1:
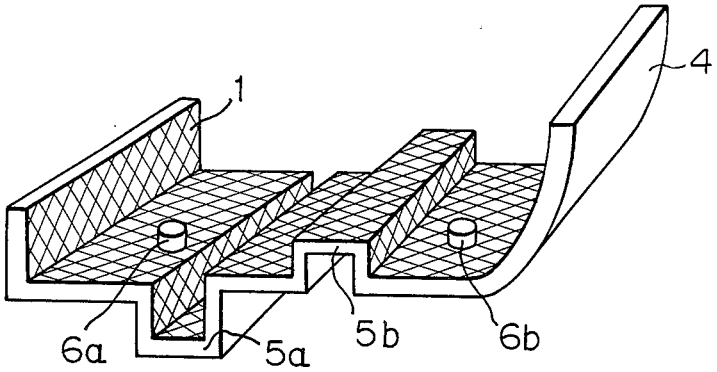
FIG. 1 is a perspective view showing an example of a shaped article made from the fabric of the present invention.

The electroconductive fibrous material of the present invention comprises a core yarn and a covering layer of a rolled electroconductive metal fiber spirally wound around the core yarn.

The fiber which constitutes the core yarn is optionally selected from organic fibers and inorganic fibers. As the organic fiber, there can be used natural organic fibers such as linen and cotton; synthetic fibers such as polyamide fibers, polyester fibers, polyacrylonitrile fibers, polyvinyl alcohol fibers, water-insolubilized polyvinyl alcohol fibers and polyolefin fibers; semi-synthetic fibers such as cellulose diacetate fibers and cellulose triacetate fibers, and regenerated fibers such as viscose rayon and cupra. As the inorganic fiber, there can be used, for example, glass fibers and carbon fibers. Generally, a polyester fiber or high-tenacity polyamide fiber which can be easily knitted or woven and has an excellent weatherability is preferably used as the fiber constituting the core yarn.

The fiber for the core yarn may be any of a multi-filament yarn, a mono-filament yarn and a spun yarn. In view of the processability, a multi-filament yarn is generally preferred. The thickness of the core yarn is not particularly critical, but is in general in the range of 50 to 3000 deniers.

The kind of the ribbon-shaped electroconductive metal fiber used in the present invention is not particularly critical, so far as it has a sufficient electroconductivity. Generally, the electroconductive metal fiber is selected from iron fibers, nickel fibers, copper fibers, aluminum fibers and stainless steel fibers. Copper fibers having a good processability to rolling or the like or stainless steel fibers having a high corrosion resistance are ordinarily preferred. Stainless steel fibers are especially preferred for the following reasons.

The reflection of electric waves is determined by the relationship between the electroconductivity and permeability of the metal. According to the theory of the skin depth represented by the following equation:

$$\delta = \sqrt{\frac{2}{\omega\mu\alpha}}$$

wherein $\mu$ stands for the permeability, $\alpha$ stands for the electroconductivity, $\omega$ is $2\pi f$, and $\delta$ stands for the depth at which the intensity of the electric field and magnetic field is 1/e, i.e., 36.8%, of the value of the surface, the thickness necessary for completely reflecting electric waves at 100 MHz of the VHF band is 66 $\mu$m in the case of copper, and about 16 $\mu$m ($\frac{1}{4}$ of the value in the case of copper) in the case of stainless steel. Since the frequency is low, the metal thickness should be increased, but in the case of stainless steel, the thickness may be reduced as compared with the case of copper. Furthermore, stainless steel has excellent shapeability and the adaptability to the covering step or the knitting or weaving step and is characterized in that electric waves within a broad frequency range can be reflected. Moreover, stainless steel is advantageous from the viewpoint of weatherability and manufacturing cost and has excellent general-purpose characteristics.

In the composite yarn of the present invention, a ribbon-shaped metal fiber is spirally wound around the core yarn.

A composite yarn having a structure opposite to the structure of the composite yarn of the present invention, that is, a composite yarn comprising a core yarn of a metal fiber and a covering layer of an organic or inorganic fiber as mentioned above, which is wound around the core yarn, cannot be practically used because processing such as knitting or weaving is extremely difficult. As is apparent, in the composite yarn of the present invention, it is preferred that a core yarn having an excellent adaptability to knitting or weaving be used.

The thickness of the metal fiber is not particularly critical but it is preferred that the thickness of the metal fiber be not larger than 50 $\mu$m, especially not larger than 30 $\mu$m. If the thickness of the metal fiber is larger than 50 $\mu$m, according to the material of the metal fiber, the bending processability is poor, and thus spiral winding of the metal fiber around the core yarn becomes difficult, and the bending resistance is lowered or the weight becomes excessive.

In the composite yarn of the present invention, the coverage of the covering layer of the metal fiber on the core yarn [the ratio (%) of the area of the peripheral surface of the core yarn covered by the metal fiber to the area of the entire peripheral surface of the core yarn] is at least 50%. If the coverage is lower 50%, when a fabric is formed by knitting or weaving, many contacts between the metal and the fiber are formed at contact points of meshes of the fabric and the electroconductivity of the fabric is reduced, with the result that the performance of the formed reflecting body is degraded and also the performance of the antenna is reduced. If the coverage exceeds 100% and ribbon-shaped filaments are superposed, the surface of the composited yarn becomes rubbery and knitting or weaving becomes extremely difficult.

If the metal fiber is extremely fine, the composite yarn is disadvantageous in that in order to attain the above-mentioned coverage, many turns of the metal fiber must be wound on the core yarn. This disadvantage can be effectively obviated by rolling and flattening the metal fiber. The rolled metal fiber has a good flexibility and hence, winding can be easily accomplished. Moreover, a large area coverage can be obtained even by a small number of winding turns.

It is preferred that the width of the ribbon-shaped metal fiber obtained by rolling be 50 to 2000 $\mu$m. If the width is smaller than 50 $\mu$m, the number of turns must be greatly increased and thus the operational efficiency is reduced, and the ribbon-shaped metal fiber is weak and readily broken and the covering efficiency is reduced. If the width is larger than 2000 $\mu$m, the ribbon-shaped metal fiber becomes solid and covering becomes difficult, and the ribbon-shaped fiber is longitudinally wrinkled, bent or piled, with the result that the covering layer becomes rugged and problems readily occur at the knitting or weaving step.

In the composite yarn of the present invention, the metal fiber is covered on the core yarn by Z-twists, S-twists or Z- and S-twists. Namely, it is satisfactory if the metal fiber is spirally wound around the core yarn. It is preferable that the composite yarn has an elongation of at least 5% in view of the knitting and weaving properties.

If an electroconductive fabric composed of the composite yarn is used for a reflecting body of a parabolic antenna for a broadcasting satellite having a frequency of 12 GHz, as now experimentally used in Japan, it is required that the size of apertures formed in the reflecting body must be not larger than ½ of the wavelength, 2.5 cm, of the above-mentioned frequency. However, in order to obtain a received image comparable to an image obtainable by a conventional parabolic antenna formed by using an aluminum plate, the size calculated as the diameter of a true circle of apertures must be not larger than 3.6 mm, i.e., 1/7 of the wavelength of the used electromagnetic wave. The lower limit of the aperture size is not particularly critical but it is preferred that the aperture size be at least 1/30 of the wavelength of the used electromagnetic wave. Note, the shape of the apertures is not particularly critical, and any optional shape can be used. The size calculated as the diameter of a true circle can be determined by measuring the area of an aperture having an optional shape and calculating the diameter of a true circle from the obtained value.

In order to obtain a received image comparable to that obtained by a conventional parabolic antenna formed by using an aluminum plate, the surface electric resistance value of the sheet must be not larger than 50 Ω. Both this condition of the surface electric resistance value and the above-mentioned condition of the aperture size must be simultaneously satisfied. If one of these conditions is satisfied, but the other is not satisfied, a clear image cannot be obtained. In order to obtain a clearer image, it is preferred that the aperture size calculated as the diameter of a true circle be not larger than 2.5 mm, i.e., 1/10 of the electromagnetic wavelength in the case of a frequency of 12 GHz, and the surface electric resistance value of the sheet be not larger than 30 Ω.

It is preferable that the electroconductive fibrous material of the present invention should have an electromagnetic wave reflectance of at least 80% to that of an aluminum plate having a thickness of 1 mm. According to the theory of the skin depth represented by the equation hereinbefore mentioned, the thickness of the metal necessary for completely reflecting electromagnetic waves varies depending on the frequency, and electromagnetic waves permeate at a certain frequency. We found that if the electroconductive fibrous material has an electromagnetic wave reflection efficiency of at least 80% based on the electromagnetic wave reflection efficiency of an aluminum plate having a thickness of 1 mm, which is the main material of a parabolic reflecting body, the electroconductive fibrous material is effective as an electromagnetic wave reflecting body. If this reflection efficiency is lower than 80%, the leakage of electromagnetic waves is increased and reception reliability is degraded, and the electroconductive fibrous material cannot be used as an electromagnetic wave shielding material.

The electroconductive fibrous material of the present invention, which is used for a parabolic reflecting body, is much lighter in the weight than a customarily used a aluminum plate, and therefore, a light-weight reflecting body can be manufactured. Furthermore, since many apertures are present in the fabric, and since the wind passes through these aperture, the wind pressure resistance can be reduced. Accordingly, the weight of a parabolic antenna comprising the reflecting body of the present invention, that is, the framework supporting this reflecting body, can be reduced and the structure can be simplified. This means that a parabolic antenna having an excellent handling property can be constructed by using the electroconductive fibrous material of the present invention.

It is preferred that the aperture size of the electroconductive fibrous material be at least 0.3 mm, which allows sufficient intrusion and penetration of a molding material. However, if the aperture size exceeds 5 mm, the leakage of electromagnetic waves (having a frequency of 100 to 1000 MHz) is great and the electromagnetic wave shielding property is drastically reduced.

As the molding material used for formation of a shaped body having an electromagnetic wave shielding property, there can be mentioned thermoplastic synthetic resins such as ABS resins, polystyrene resins, modified polyethylene terephthalate (PET) resins and polyolefin resins, thermosetting resins such as phenolic resins and polyester resins, and rubbery products composed of synthetic rubbers such as butadiene rubbers and polyolefin rubbers.

In the electroconductive fabric of the present invention, even in the case of a shaped body having a complicated shape including curved portions differing in the curvature and/or convex-concave portions, a uniform electromagnetic wave shielding property can be imparted to the entire structure.

Since the electroconductive fabric of the present invention can be shaped integrally with the molding material, peeling of the fabric is not caused in the resulting shaped body and the durability of the electromagnetic wave shielding surface is good.

A shaped body having an electromagnetic wave shielding property, which is obtained by using the electroconductive fibrous material of the present invention, will now be described.

Figure 2:
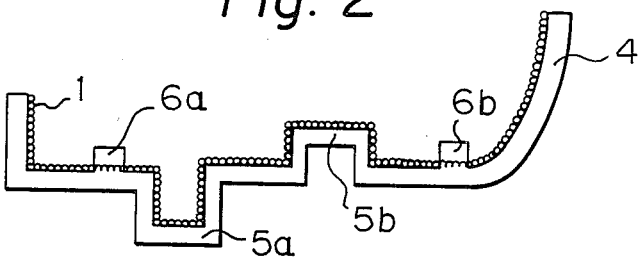
FIG. 2 is a sectional view of the shaped article shown in FIG. 1.

FIG. 1 shows an example of a shaped body having an electromagnetic wave shielding property, and prepared from the electroconductive fibrous material of the present invention, and FIG. 2 shows a sectional view of this shaped body. As shown in FIG. 1, this shaped body comprises a substrate 4 formed of a synthetic resin or rubbery material and a metal fiber-containing electroconductive fibrous material 1 according to the present invention, which is arranged along the inner surface of the substrate 4 integrally with the substrate 4. As clearly shown in FIG. 2, in relatively large curved portions of the shaped body, for example, concave and convex portions *5a* and *5b*, the electroconductive fibrous material 1 is arranged along the inner surface of the shaped body, but in projections *6a* and *6b* the molding material per se is projected inward beyond the electroconductive fibrous material 1. The projections *6a* and *6b* are formed by molding the molding material integrally with the substrate 4 beyond apertures of the electroconductive fibrous material 1 at the molding step for formation of the shaped body. Accordingly, the electroconductive fibrous material 1 is not exposed to the surfaces of the projections *6a* and *6b*, and electric insulation can be maintained by these portions.

A collapsible parabolic antenna constructed by using the electroconductive fibrous material of the present invention will now be described.

The framework of the collapsible parabolic antenna of the present invention comprises a central shaft, a plurality of wing ribs and a plurality of push-up ribs or brackets which push up the wing ribs when the wing ribs are opened. This structure resembles the structure of an ordinary umbrella, and the construction of the framework and the attachment of the electroconductive fabric to the framework may be similar to those in an ordinary umbrella. However, the shape of the wing ribs must be set so that a paraboloid is formed when the parabolic antenna is opened. In order to maintain a paraboloid in a better state, it is preferred that the number of the wing ribs be large, so long as the weight of the parabolic antenna is not excessively increased. Ordinarily, 14 to 16 wing ribs are arranged. Furthermore, unlike an ordinary umbrella, the parabolic antenna may have a structure in which the top end of the central shaft, that is, the top end on the convex side of the paraboloid, is prolonged and the antenna is mounted on the ground at this prolonged top end directly or through an appropriate fixing member. Any materials having a satisfactory rigidity can be used as the material of the framework, but from the viewpoint of durability, the use of stainless steel or glass fiber is preferred.

In the collapsible parabolic antenna of the present invention, since the electroconductive fabric is used as the reflecting sheet, the weight is reduced and the antenna can be easily folded, and therefore, the storing or mounting position can be easily changed. Furthermore, since the air permeability of the electroconductive fabric is high, the wind resistance of the parabolic antenna is reduced. This means that a parabolic antenna having a large diameter can be prepared and the electromagnetic wave catching property thereof can be improved.

The construction of the collapsible parabolic antenna of the present invention will now be described in detail with reference to an example illustrated in the accompanying drawings.

Figure 3:
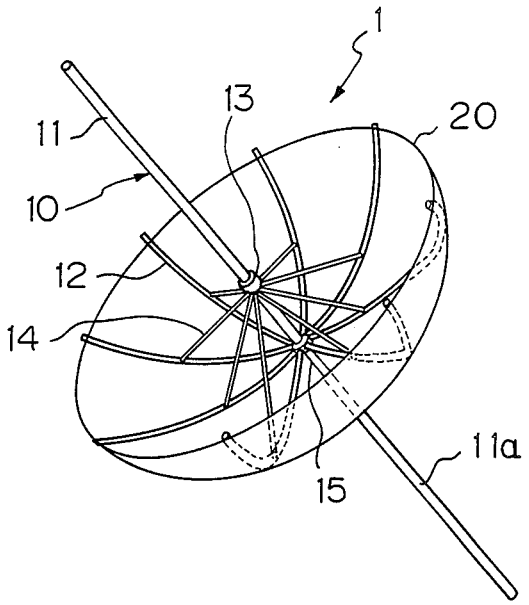
FIG. 3 is a perspective view illustrating an example of the collapsible parabolic antenna according to the present invention in the opened state.
Figure 4:
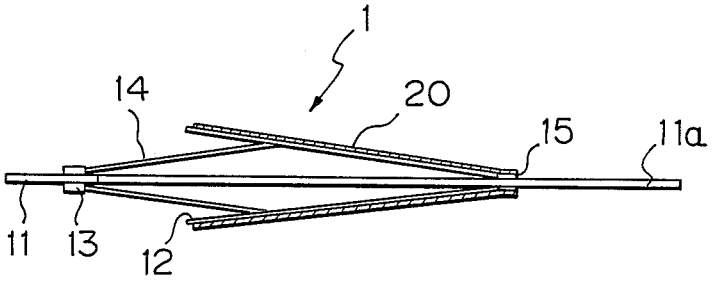
FIG. 4 is a view showing the longitudinal section of the collapsible parabolic antenna shown in FIG. 3 in the folded state.

FIG. 3 is a perspective view illustrating one example of the collapsible parabolic antenna of the present invention in the opened state, and FIG. 4 is a view showing the longitudinal section of the antenna in the folded state.

The collapsible parabolic antenna 1 of the present invention comprises a framework 10 and an electroconductive fabric 20. The framework 10 comprises a central shaft 11, a join 15 secured to one point of the central shaft 11, a plurality of wing ribs 12 rotatably pivoted on the joint 15 and having a parabolic shape, a bracket 13 slidably attached to the central shaft 11 and a plurality of push-up ribs 14 for connecting the bracket 13 to substantially central parts of the wing ribs 12. The framework 10 is constructed according to the structure of an ordinary umbrella. In the example shown in FIG. 3, the right lower end 11*a* in FIG. 3 of the central shaft 11 is different from that of an ordinary umbrella in that it is further extended, so that the end portion 11*a* serves to mount the parabolic antenna on the ground directly or through a fixing tool. Of course, a modification may be adopted in which the end portion 11*a* is not formed but a special fixing member is used for fixing the antenna to the ground.

The number of the wing ribs 12 is larger than the number shown in the drawings. The electroconductive fabric 20 is attached to the wing ribs 12 by using a yarn, a strong adhesive or the like so that when the parabolic antenna is opened, a paraboloid is formed by the electroconductive fabric 20.

As shown in FIG. 4, by sliding the bracket 13, the parabolic antenna can be folded and the bulk and volume of the antenna can be reduced when it is stored or carried about.

In the example shown in FIGS. 3 and 4, the electroconductive fabric 20 is arranged outside the framework 10, but in view of the function of the parabolic antenna, the electroconductive fabric 20 may be fixed on the inner side of the wing ribs. In this case, after the electroconductive fabric 20 is attached to the wing ribs 12, the push-up ribs 14 need not be attached.

Figure 5:
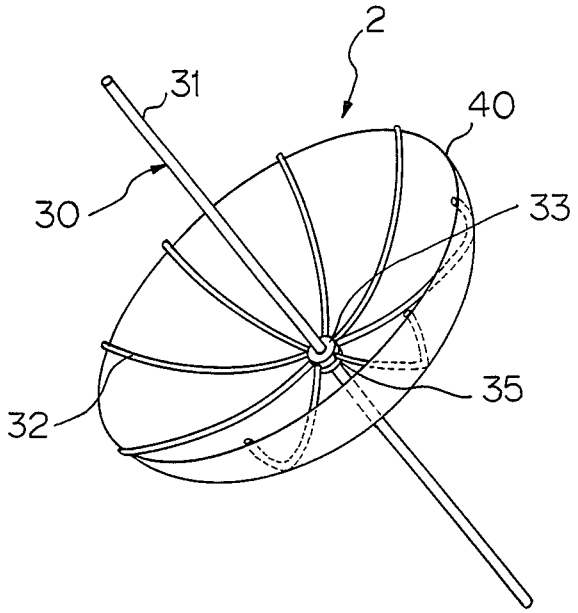
FIG. 5 is a perspective view illustrating another example of the collapsible parabolic antenna according to the present invention in the opened state.
Figure 6:
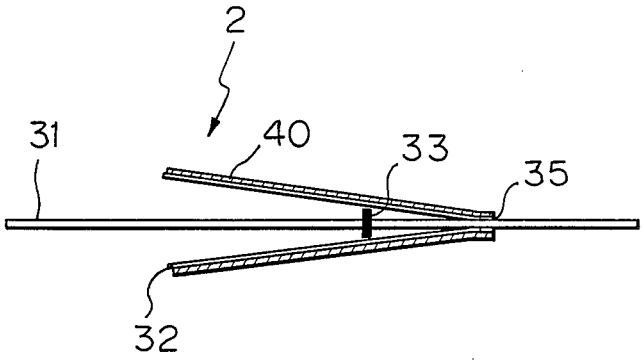
FIG. 6 is a view showing the longitudinal section of the collapsible parabolic antenna shown in FIG. 5 in the folded state.

FIG. 5 is a perspective view showing another example of the collapsible parabolic antenna of the present invention in the opened state, and FIG. 6 is a view showing the longitudinal section of the antenna in the folded state.

This collapsible parabolic antenna 2 comprises a framework 30 and an electroconductive fabric 40. The framework 30 comprises a central shaft 31, a joint 35 secured at one point of the central shaft 30, a plurality of wing ribs 32 rotatably pivoted on the joint 35 and having a parabolic shape and a bracket 33 slidably attached to the central shaft 30 to support the wing ribs 32. If the push-up ribs are omitted as in this example, irregular reflection of electromagnetic waves by the push-up ribs is eliminated and the reception performance is improved. However, the reflecting body is supported by the bracket alone at one point. Accordingly, it is preferred that the reflecting body be further secured by passing a piano wire 34 or the like through the top ends of the wing ribs so as to prevent the reflecting body from vibrating.

The present invention will now be described in detail with reference to the following examples directed to reflecting bodies of parabolic antennae and other applications of the electroconductive fibrous material of the present invention.

The definitions and measurement methods of the characteristics referred to in the instant specification are described below.

Aperture Size

As pointed out hereinbefore, the size of apertures penetrating through the electroconductive fibrous material substantially in the vertical direction is expressed in terms of the value calculated as the diameter of a true circle. This is because apertures defined by filaments in a knitted or woven fabric do not have a circular shape but a rectangular or deformed ellipsoidal shape. Therefore, the aperture size is determined as follows. A copy of the sheet is obtained by a copying machine and areas of the apertures appearing in the copy are calculated by supposing that these apertures have a shape of a true circle, and the values are calculated from the diameters of the true circles. The aperture size is expressed by a mean value of the diameters of five apertures.

Surface Electric Resistance Value

A sheet sample having a size of 70 mm×90 mm is prepared, and both ends of the sample are gripped along a length of 10 mm in the width of 90 mm by two copper sheets having a width of 10 mm and a thickness of 3 mm. The electric resistance between the copper sheets at both ends is measured by using a tester and the surface electric resistance of an area 70 mm×70 mm is thus obtained.

Electric Resistance Unevenness

A sample fabric having a size of 100 mm×100 mm is prepared and the electric resistance along a distance of 3 cm is randomly measured. The difference between the maximum value and the minimum value is calculated.

Electromagnetic Wave Reflectance

A sample of 80 cm×80 cm is prepared and spread on a wood frame, and the sample is placed in an electromagnetic wave-shielded room and irradiated with an electromagnetic wave of 12 GHz emitted from an oscillator. The reflected electromagnetic wave is detected by a receiver and measured by a power meter for microwaves. The obtained value is compared with a value obtained with respect to an aluminum plate having a thickness of 1.0 mm according to the same method.

Reception State

A sheet of the present invention or a comparative sheet is attached to a wood plate having a shape of a parabolic antenna reflecting body having a diameter of 75 cm, and electric waves of a frequency band of 12 GHz from a broadcasting satellite are received and the sharpness, etc. of the obtained image is compared with an image obtained by a parabolic antenna of aluminum having a diameter of 75 cm.

EXAMPLE 1

A rolled ribbon-shaped stainless steel line (having a width of 0.4 mm and a thickness of 0.02 mm) was wound around the periphery of a polyester filament yarn (250 d/83 f) at 2300 turns per meter to obtain an electroconductive composite yarn. An electroconductive fabric having a T-cloth texture was formed from this composite yarn by means of a 7 G flat knitting machine. The electromagnetic wave reflectance, processability, electric resistance unevenness and antenna characteristics of the fabric were evaluated according to the above-mentioned methods. The obtained results are shown in Table 1.

EXAMPLE 2

A stainless steel fiber (having a thickness of 0.045 mm and a width of 0.4 mm) was wound around the periphery of a polyester filament yarn (150 d/48 f) at 2000 turns per meter to obtain an electroconductive composite yarn. From this composite yarn, an electroconductive fabric having a T-cloth texture was formed by a 10 G flat knitting machine. The obtained fabric was evaluated in the same manner as described in Example 1. The obtained results are shown in Table 1.

EXAMPLE 3

From the stainless steel fiber-covered composite yarn prepared under the same conditions as described in Example 1, a tire woven fabric in which both the warps and wefts were regularly arranged at a density of 10 yarns per inch was prepared. The characteristics of the obtained electroconductive fabric were evaluated in the same manner as described in Example 1. The obtained results are shown in Table 1.

EXAMPLE 4

The same stainless steel fiber as used in Example 1 was wound at 1000 turns per meter around the periphery of a nylon-66 multi-filament yarn (70 d/24 f) as the core yarn, and from this composite yarn, an electroconductive fabric was formed by means of 12 G flat knitting machine. The obtained electroconductive fabric was evaluated in the same manner as described in Example 1. The obtained results are shown in Table 1.

EXAMPLE 5

The fabric obtained in the same manner as described in Example 1 was placed between a pair of molds for a bottom lid of a desk computer and held by the molds to closely fix the periphery of the elongated fabric. The elongation degrees in the longitudinal and lateral directions of the molds (the ratio of the length along the inner face of the molds to the length of the straight line connecting both ends of the molds) were 12% and 15%, respectively. By means of an injection molding machine, a modified polyphenylene oxide resin (Zylon® supplied by Asahi Kasei KOGYO K.K.) was injected under an injection pressure of 500 kg/cm$^2$ at a resin temperature of 250° C. from the front surface side of the bottom lid of a desk computer. After cooling, the integrated molded body was taken out. The electroconductive elongated fabric adhered closely to the curved surface of the molded body and the resin was fitted among spaces of the elongated fabric. Accordingly, the adherence was very good. Furthermore, the elongated fabric was not exposed to the surfaces of four projections having a maximum diameter of 8 mm and a height of 7 mm and two projections having a maximum diameter of 15 mm and a height of 2 mm, which were formed on the inner surface of the molded body, but these projections were composed solely of the resin. The electromagnetic wave shielding property (100 MHz to 1000 MHz) was higher than 40 dB.

COMPARATIVE EXAMPLE 1

A plain weave fabric of polyester multi-filament yarns (150 d/48 f) having a mesh distance of 0.15 cm was subjected to sensitizing and activating treatments and chemically plated with nickel according to customary procedures to obtain an electroconductive fabric. Some plating unevenness was observed in this electroconductive fabric, and when the electroconductivity was measured by using a tester, it was found that there was a deviation of 10 to 45 Ω/4 cm. The electroconductive fabric was evaluated in the same manner as described in Example 1. The obtained results are shown in Table 1.

COMPARATIVE EXAMPLE 2

The properties of a commercially available metal net having a mesh size of 0,3 cm were determined in the same manner as described in Example 1. The obtained results are shown in Table 1.

COMPARATIVE EXAMPLE 3

Aluminum was flame-sprayed on the same fabric as used in Comparative Example 1 to obtain an electroconductive fabric. The weight of adhering aluminum was 70% based on the weight of the fabric. The properties of the obtained fabric were determined in the same manner as described in Example 1. The obtained results are shown in Table 1.

COMPARATIVE EXAMPLE 4

By using the same molds for a bottom lid of a desk computer, as used in Example 5, a molded body was obtained by using as ABS resin alone. The inner surface of the molded body was coated with an electroconductive paint (nickel-incorporated acrylic resin paint) in a thickness of 50 millimicrons. The surface resistance was 0.9 Ω/cm$^2$ and the electromagnetic wave shielding property was 32 dB. Separately, the projections present on the molded body were masked and the electroconductive paint was coated in a thickness of 50 millimicrons, and after drying, the mask layer was removed. The surface resistance of the electroconductive coating of the molded body was 1,0 $\Omega/cm^2$ but the electromagnetic wave shielding property was as low as 18 dB.

EXAMPLE 6

A copper line having a width of 0.3 mm and a thickness of 0.025 mm was wound at 2000 turns per meter around the periphery of a polyester filament yarn (250 d/30 f) by means of a covering machine, and an electroconductive knitted fabric of a T-cloth texture was made from the obtained electroconductive composite yarn by using a 10 G flat knitting machine. The properties of the obtained electroconductive fabric were determined in the same manner as described in Example 1. The obtained results are shown in Table 1.

EXAMPLE 7

An aluminum wire having a width of 0.2 mm and a thickness of 0.03 mm was wound at 1800 turns per meter around the periphery of a polyester filament yarn (250 d×50 f) by means of a covering machine, and an electroconductive knitted fabric of a T-cloth texture was prepared from the so-obtained composite yarn by means of a 10 G flat knitting machine. The properties of the so-obtained electroconductive fabric were determined in the same manner as in Example 1. The obtained results are shown in Table 1.

TABLE 1

| | Mesh Size (cm) | Surface Electric Resistance (Ω) | Electric Resistance Unevenness (Ω) | Electromagnetic Wave Reflectance (% to aluminium) | Reception State of Antenna | Processability |
|---|---|---|---|---|---|---|
| Example 1 | 0.25 | 0 | 0 | 96 | Good | Good |
| Example 2 | 0.18 | 0 | 0 | 99 | Good | Good |
| Example 3 | 0.25 | 3 | 1 | 92 | Good | Fair |
| Example 4 | 0.20 | 25 | 6 | 88 | Fair | Good |
| Example 6 | 0.18 | 0 | 0 | 98 | Good | Good |
| Example 7 | 0.20 | 0 | 1 | 96 | Good | Good |
| Comparative Example 1 | 0.15 | 61 | 15 | 72 | Bad | Fair |
| Comparative Example 2 | 0.3 | 0 | 0 | 90 | Good | Solid, little deformable |
| Comparative Example 3 | 0.15 | 0 | 0 | 94 | Good | Fabric hardened, flexibility and bendability degraded, peeling of aluminum layer by stretching |

We claim:

1. An electroconductive fibrous material comprising a composite yarn comprising a core yarn composed of at least one kind of fiber selected from the group consisting of organic fibers and inorganic fibers and a covering layer composed of a ribbon-shaped metal fiber spirally wound around the core yarn, the coverage of the ribbon-shaped metal fiber to the core yarn being at least 50%.

2. An electroconductive fibrous material as set forth in claim 1, which is in the form of a fabric.

3. An electroconductive fibrous material as set forth in claim 2, further comprising apertures penetrating substantially in the vertical direction, wherein the size of said apertures, calculated as a diameter of a true circle, is smaller than 1/7 of the wavelength of the used electromagnetic wave, and wherein said composite yarn is selected to have a surface electrical resistance, as measured with respect to a sample having a size of 70 mm×70 mm, of not larger than 50 Ω.

4. An electroconductive fibrous material as set forth in claim 2, wherein said electroconductive fibrous material is formed from said composite yarns having a covering layer such that said electroconductive fibrous material has an electromagnetic wave reflectance of at least 80% of that of an aluminum plate having a thickness of 1 mm.

5. An electroconductive fibrous material as set forth in claim 1, wherein said organic fibers are selected from the group consisting of linen, cotton, polyamide fibers, polyester fibers, polyacrylonitrile fibers, polyvinyl alcohol fibers, water-insolubilized polyvinyl alcohol fibers, polyolefin fibers, cellulose diacetate fibers, cellulose triacetate fibers, viscose rayon and cupra.

6. An electroconductive fibrous material as set forth in claim 1, wherein said inorganic fibers are selected from glass fibers and carbon fibers.

7. An electroconductive fibrous material as set forth in claim 1, wherein said ribbon-shaped metal fiber is selected from iron fibers, nickel fibers, copper fibers, aluminum fibers and stainless steel fibers.

8. An electroconductiye fibrous material as set forth in claim 1, wherein said ribbon-shaped metal fiber is a stainless steel fiber.

9. An electroconductive fibrous material as set forth in claim 1, wherein said ribbon-shaped metal fiber has a thickness not larger than 50 μm.

10. An electroconductive fibrous material as set forth in claim 1, wherein said core yarn and said covering layer are selected so that said composite yarn has an elongation of at least 5%.

11. An electroconductive fibrous material as set forth in claim 1, wherein the fineness of said core yarn is 50 to 3,000 denier.

12. A parabolic reflecting body composed of an electroconductive fibrous material as set forth in claim 1.

13. A collapsible parabolic antenna which comprises a collapsible framework comprising a central shaft, a plurality of wing ribs rotatably pivoted on one point of said central shaft, a bracket slidably attached to said central shaft and a plurality of push-up ribs for connecting said wing ribs to the bracket, and a sheet supported by the wing ribs to cover spaces between adjacent wing ribs, wherein the shape of the wing ribs is determined so that when the parabolic antenna is opened, a paraboloid is formed, and the sheet is composed of an electroconductive fibrous material as set forth in claim 1.

14. A parabolic antenna as set forth in claim 13, wherein the electroconductive fibrous material has a covering layer composed of a ribbon-shaped stainless steel fiber.

15. An electromagnetic wave shielding material in the form of a fabric comprising a composite yarn including a core yarn composed of at least one kind of fiber selected from the group consisting of organic fibers and inorganic fibers and a covering layer composed of a ribbon-shaped metal fiber spirally wound around the core yarn, the coverage of the ribbon-shaped metal fiber to the core yarn being at least 50%.

16. An electroconductive fibrous material as set forth in claim 15, further comprising apertures penetrating substantially in the vertical direction, wherein the size of said apertures, calculated as a diameter of a true circle, is smaller than 1/7 of the wavelength of the used electromagnetic wave, and wherein said composite yarn is selected to have a surface electrical resistance, as measured with respect to a sample having a size of 70 mm×70 mm, of not larger than 50 Ω.

17. An electroconductive fibrous material as set forth in claim 15, wherein said electroconductive fibrous material is formed from said composite yarns having a covering layer such that said electroconductive fibrous material has an electromagnetic wave reflectance of at least 80% of that of an aluminum plate having a thickness of 1 mm.

* * * * *